US005340486A

United States Patent [19]

Willoughby

[11] Patent Number: 5,340,486

[45] Date of Patent: Aug. 23, 1994

[54] LUBRICANT COMPOSITIONS FOR USE IN DIECASTING OF METALS AND PROCESS

[75] Inventor: Anthony P. Willoughby, Plymouth, United Kingdom

[73] Assignee: Acheson Industries, Inc., Port Huron, Mich.

[21] Appl. No.: 91,326

[22] Filed: Jul. 14, 1993

Related U.S. Application Data

[63] Continuation-in-part of Ser. No. 936,581, Aug. 27, 1992, abandoned.

[51] Int. Cl.[5] ..... C10M 173/00; C10M 143/04; B28B 7/36; C04B 35/68

[52] U.S. Cl. ..... 252/43; 252/49.5; 106/38.22

[58] Field of Search ..... 252/43, 49.5; 106/38.22

[56] References Cited

U.S. PATENT DOCUMENTS

| | | | |
|---|---|---|---|
| 3,298,954 | 1/1967 | Brown | 252/49.5 |
| 3,554,910 | 1/1971 | Johnson | 252/49.5 |
| 4,749,504 | 6/1988 | Aihara et al. | 252/49.5 |

*Primary Examiner*—Jerry D. Johnson
*Attorney, Agent, or Firm*—Dinnin & Dunn

[57] ABSTRACT

Polypropylene is used as a component of a lubricant-/release agent composition in diecasting of metals, with the composition containing the polypropylene finely dispersed in a liquid carrier, for example in an aqueous emulsion; and, a process of diecasting metal parts using said composition.

34 Claims, No Drawings

LUBRICANT COMPOSITIONS FOR USE IN DIECASTING OF METALS AND PROCESS

CROSS-REFERENCE TO RELATED APPLICATION

This application is a continuation-in-part of application Ser. No. 07/936,581 filed Aug. 27, 1992 now abandoned.

BACKGROUND OF THE INVENTION

This invention generally relates to lubricant compositions for use in diecasting of metals, having improved lubricant and release properties.

Diecasting machines, which include the pressure diecasting and squeeze casting processes, operate under high pressures and temperatures. The faces of the dies must be lubricated and sealed so that the cast metal can flow efficiently and can be released cleanly. In addition, various moving parts must be lubricated. The basic requirements of lubricant compositions for diecasting are as follows: (1) Parting Ability—it must be possible to release the castings from the die surface without distortion or undue stress. (2) Barrier Formation—the lubricant must form a physical barrier between the cast metal and the face of the die in order to reduce adhesion of the cast metal to the die surface (referred to as "soldering" or "galvanizing", depending on the metal being cast). (3) Control of Surface Finish—the lubricant composition must not leave undesirable residues on the die face which might corrode the steel or impair the surface of the casting and hinder or prevent subsequent finishing operations. (4) Soundness of Casting—the lubricant composition must not give off excessive amounts of gas which might lead to porosity of the casting surface and affect the pressure tightness of the castings. (5) Health and Safety—it is important that lubricants do not contain dangerous or toxic components or components which will react to form undesirable byproducts.

In the early days of diecasting, various pastes, oils, greases, and waxes were used and these were applied to the die by various means including brushing. These materials often caused a severe fume problem as solvent and oil evaporated or burned off the hot die surface.

Silicone oils in some instances can be effective release agents, however under most conditions the silicone oils lack sufficient lubricant properties, especially for moving pans. Still further, hydrocarbon oils or polyethylene can cause the buildup of degradation products on the die faces and on the exterior of the dies. Buildup on the die faces themselves leads to inferior casting and surface staining, and shortens the overall life of the die. Deposits on the outside of the die can be troublesome and difficult to remove, requiring mechanical abrasion in the absence of effective solvents. Build up on the mating surfaces of dies can prevent complete closure of the dies, leading to dimensional inaccuracies of the castings.

There has thus been a need in the art for an improved lubricant/release agent which has the appropriate surface active properties to "wet" the die surface, suitable viscosity ranges to flow evenly, but stay in place on the die surface during the casting operation, while at the same time being suitably fugitive or removable so as to provide clean castings and die surfaces.

SUMMARY OF THE INVENTION

It has been discovered that the use of polypropylene fulfills the above requirements and that its usage as described in the invention herein provides unexpectedly unique results. Typically, the polypropylene will be applied as a finely divided dispersion in a carrier; and, in general the polypropylene is desirably formulated as an aqueous emulsion which can be sprayed onto the die to leave a surface film of the polypropylene after evaporation of the aqueous carrier.

Broadly stated, this invention involves a new die lubricant and release agent composition containing polypropylene in a liquid carrier.

From a more specific aspect, the invention concerns a water based die lubricant and release agent composition, comprising in percent by weight: (a) about 0.01% to about 40% polypropylene having an average molecular weight between about 500 and about 300,000, (b) zero to about 50% silicone oil. (c) about 0.01% to about 8% of an emulsifying agent to assist in maintaining the components of the composition in an emulsified form, (d) zero to about 5% of an anti-corrosion agent, and the balance water.

From a process aspect, the invention concerns a process of diecasting metal parts or metal products including the steps of: treating the die with a die lubricant and release agent composition containing polypropylene in a liquid carrier, diecasting the metal product, and removing the product from the die; and, the invention also concerns the products formed by said process.

DESCRIPTION OF PREFERRED EMBODIMENTS

The polypropylene suitable for this invention should, in general, have an average molecular weight between about 500 and about 300,000; and preferably between about 2500 and about 10,000; with most preferred results being obtained using polypropylene having an average molecular weight of between about 4000 and about 5000. The polypropylene should be in solids form. So called crystalline polypropylene is ideal, for example having a relatively sharp melting point (for example in the range of approximately 120°–180° C.). Typically the polypropylene is used in the composition in the form of an aqueous emulsion such as Emrel 7 (40% solids) obtained from Hickson and Welch Ltd. Other types of polypropylene may also be used, such as polypropylene particulate material or powdered material; for example, Eltex HY-P or Eltex RP-P products (obtained from Solvay Chemical Co.). The polypropylene used whether in aqueous emulsion form or solid powder form, in either event, is dispersed in the composition. As will be seen from the examples given herein the molecular weight of the polypropylene is sometimes specified with the letter "D" being used. This stands for the Dalton technique or methodology of describing or delineating the molecular weight. By the term polypropylene as used herein it is meant to include polypropylene homopolymers, polypropylene block propylene-ethylene copolymers, polypropylene random propylene-ethylene copolymers, and polypropylene block or random propylene-other unsaturated hydrocarbon monomer copolymers; however, as referred to above the polypropylene used herein should be in solids form, and if any other copolymer material is present (e.g., ethylene, butene, pentene, hexene, or the like), then the other copolymer materials should form no more than 28 mole % of the polypropylene copolymer, and preferably no more than 20 mole %. By the term substantially pure polypropylene as used herein it is meant to include polypropylene homopolymer, and also polypropylene copolymers which contain no more than 28 mole % of another material copolymerized with the polypropylene.

The polypropylene in the composition should generally be present within the range of approximately 0.01% to about 40% by weight of the composition, with preferred results being obtained when the polypropylene is present within the range of about 0.02% to about 20% by weight of the composition; and with best results being obtained when the polypropylene is present within the range of about 0.1% to about 15% by weight of the composition.

As referred to, polypropylene or polypropylene emulsions used herein contain appropriate emulsifying agents or suspending agents, and particularly useful for this purpose are the non-ionic surfactants such as ethoxylated alcohols discussed below. The lubricant compositions in accordance with this invention may also suitably contain other components, such as silicone oils, mineral oils, anti-corrosion agents and the like, as will be discussed hereinafter. The lubricant compositions described herein may be formulated as end usage compositions, or as concentrates which are diluted shortly before usage. The concentrates are typically diluted in a ratio of about 1:10 to about 1:100 by volume.

It has been discovered that the use of polypropylene as described in this invention provides distinct and surprising advantages over the use of past lubricant/release agents. The polypropylene provides far fewer deposits of degradation products while also degrading cleanly and, most importantly, without causing porosity of the casting. The castings are cleaner and brighter, making them more suitable for subsequent processing such as plating; and, the dies and die faces remain cleaner and truer.

The silicone oil, when used in the lubricant composition, can be any one of a number of different commercially available materials. Typical examples of such silicone oils are Union Carbide L-42, Dow Corning 203, General Electric SF-1080 and the silicone oil product known as Wacker TN. These same silicone oils are available in aqueous emulsified form by product designations known as, for example, Wacker TNE; Union Carbide LE-420/HS; General Electric SM-2154; and Dow Corning No. 290. The silicone oils used are preferably an organo modified polysiloxane silicone oil. The silicone oil may be present within the range of zero to about 50% by weight of the composition, with more preferred results being obtained when the silicone oil is present within the range of about 0.1% to about 23% by weight; and with best results being obtained when the silicone oil or silicone fluid is present within the range of about 0.5% to about 13% by weight of the composition.

The emulsifying agent for use in the composition serves the function of maintaining the ingredients of the composition in an emulsified form within the liquid carrier system, and are generally referred to as non-ionic emulsifying agents. The emulsifying agent should generally be present within the range of about 0.01% to about 8% by weight of the composition. Preferred results are obtained when the emulsifying agent is present within the range of about 0.02% to about 6% by weight; with best results being obtained when the emulsifying agent is present within the range of about 0.1% to about 5% by weight of the composition. Typical emulsifying agents or wetting and dispersing agents are: the ethoxylated alcohols, such as: Genapol X 060 and Genapol X 080 (available from Hoechst Chemicals); also usable are the Nonyl Phenol alcohols, such as, Antarox CO-530 and Antarox CO-630 (available from Rhone-Poulenc Chemicals Co.) [available in the U.S.A. as Igepal CO-530 or CO-630]; and ethoxylated castor oil, such as Emulan-EL (available from BASF).

The anti-corrosion agent referred to herein is an optional ingredient in the composition, which may generally be present within the range of about zero to about 5% by weight of the lubricant composition. Preferably the anti-corrosion agent is present within the range of about 0.01% to about 4% by weight of the composition, and most suitable results are obtained when the anti-corrosion agent is present within the range of about 0.1% to about 3% by weight of the composition. Examples of suitable anti-corrosion agents are: sodium nitrite, sodium benzoate, triethanolamine salts, cheminite 10-01, and Becrosan BTO (available from Carl Becker GmBH).

Other additives may also be used in the lubricant composition of this invention, such as, mineral oil, synthetic or natural oil, preservative agents, anti-foam agents, or bactericide agents. When these other additives are used they should generally be present within the range of about 0.02% to about 35% by weight of the composition, with preferred results being obtained when these other additives are present within range of about 0.1% to about 30% by weight of the composition. The bactericide or preservative agents are for the purposes of preventing spoilage of the product. Suitable bactericide agents: Acticide BX (Thor Chemicals company, U.K.) which can be described as a synergistic blend of aromatic compounds, that is, a blend of isothiazilone and chloroacetamide with n-formal: or Emulcid (available from Thor Chemicals), or Grotan BK (available from Sterling Industrial company), with both of these latter materials being Hexahydro-1, 3, 5 Tris (2 hydroxy ethyl)-s-triazine.

The liquid carrier for the composition is preferably water, however, it may also be selected from a number of other materials such as mineral oil or mineral spirits.

In order to further illustrate the invention, the following examples are provided. It is to be understood, however, that the examples are included for illustrative purposes and are not intended to be limiting of the scope of the invention as set forth in the subjoined claims. In all the examples the materials used are specified in percentage by weight.

EXAMPLE 1

| (All In % By Weight) | |
|---|---|
| Emulsified Polypropylene: Oxidized Polypropylene Homopolymer of Average Molecular Weight 4,500D; As Present in Emrel 7, Polypropylene Aqueous Emulsion, (30% solids version) (Hickson and Welch Ltd.) | 1.65% |
| Silicone Oil Aqueous Emulsion: (Dow Corning 290) Organo Modified Polysiloxane Silicone Fluid Aqueous Emulsion. 50% Solids content. | 15.30% |
| Ethoxylated Alcohol Emulsifier | 0.20% |
| Anti-corrosion Agent Becrosan BTO, (Carl Becker GmBH) | 2.00% |
| Water | 80.85% |
| | 100.00% |

The above composition, for end usage, is diluted with water at a ratio of approximately 1:40 parts by volume water. The diluted composition is then sprayed on to the die surface for approximately 10–15 seconds, and the diecast parts are then formed, e.g., automotive engine parts such as manifolds, gear box casings, rocker covers etc.

EXAMPLE 2

| | |
|---|---|
| Emulsified Polypropylene: Oxidized Polypropylene Homopolymer of Average Molecular Weight 4,500D; As Present in Emrel 7 Polypropylene Aqueous Emulsion (40% solids version) (Hickson and Welch Ltd.) | 1.80% |
| Silicone Oil Aqueous Emulsion: (Dow Corning 290) Organo Modified Polysiloxane Silicone Fluid Aqueous Emulsion. 50% Solids content. | 15.30% |
| Ethoxylated Alcohol Emulsifier | 0.23% |
| Anti-corrosion Additive Becrosan BTO, (Carl Becker GmBH) | 2.00% |
| Water | 80.67% |
| | 100.00% |

The above composition, for end usage, is diluted with water at a ratio of approximately 1:40 parts by volume water. The diluted composition is then sprayed on to the die surface for approximately 10–15 seconds, and the diecast parts are then formed, e.g., automotive engine parts such as manifolds, gear box casings, rocker covers etc.

EXAMPLE 3

| | |
|---|---|
| Polypropylene Aqueous Emulsion PERMANOL 1111 (34% solids) | 11.00% |
| Silicone Oil Aqueous Emulsion (50% solids) (DC-290) | 17.9% |
| Water | 71.10% |
| | 100.00% |

EXAMPLE 4

| | |
|---|---|
| Polypropylene Aqueous Emulsion (Emrel 7, 40% solids content) | 35.00% |
| Silicone Oil Aqueous Emulsion (50% solids) (DC 290) | 10.00% |
| Water | 55.00% |
| | 100.00% |

EXAMPLE 5

| | |
|---|---|
| Polypropylene Dispersed Powder 0.2 to 2 microns average diameter particles Molecular weight 4,000 to 20,000 D. | 1.80% |
| Silicone Oil Aqueous Emulsion (50% solids) (DC 290) | 15.30% |
| Ethoxylated Alcohol Emulsifier Non ionic dispersing and wetting agent | 0.18% |
| Anti-corrosion Agent (Becrosan BTO) | 2.00% |
| Preservative | 0.20% |
| Water | 80.52% |
| | 100.00% |

EXAMPLE 6

| | |
|---|---|
| Polypropylene Aqueous Emulsion (40% solids) | 2.00% |
| Silicone Oil Aqueous Emulsion (50% solids) | 2.70% |
| Non-ionic Emulsifier | 4.90% |
| Mineral Oil | 24.30% |
| Preservative | .10% |
| Water | 66.00% |
| | 100.00% |

EXAMPLE 7

| | |
|---|---|
| Polypropylene Aqueous Emulsion (Emrel 7 40% solids) | 13.1% |
| Mineral Oil Aqueous Emulsion (26.2% mineral oil) | 86.7% |
| Preservative | 0.2% |
| | 100.00% |

EXAMPLE 8

| | |
|---|---|
| Polypropylene Aqueous Emulsion (Emrel 7, 40% solids) | 16.0% |
| Natural Oil Aqueous Emulsion Natural oil, e.g. Soya or Lard oil (40% solids oil content) | 80.0% |
| Preservative | 0.2% |
| Water | 3.8% |
| | 100.00% |

EXAMPLE 9

| | |
|---|---|
| Polypropylene Aqueous Emulsion (Emrel 7, 40% solids) | 40.0% |
| Preservative | 0.2% |
| Water | 58.8% |
| | 100.00% |

EXAMPLE 10

Same as previous Example No. 2 but with polypropylene powder (0.2 to 2 microns average particle size diameter) used in place of the polypropylene emulsion in such proportion as to result in the same content of polypropylene in the product as was present due to the contribution of the polypropylene emulsion used in Example No. 2.

EXAMPLE 11

| | |
|---|---|
| Emulsified Polypropylene As Present in a 40% Solids Content Aqueous Emulsion (Emrel 7) | 1.80% |
| Silicone Oil (DC-203) | 6.85% |
| Ethoxylated Alcohol Emulsifiers Emulsifier (Genapol X-060) | 1.09% |
| Anti-corrosion Agent (Becrosan BTO) | 2.00% |
| Preservative | .10% |
| Bactericide (Hexahydrotriazine) | 0.12% |
| Anti-foam Agent (SAG 100) | 0.05% |
| Water | 87.99% |
| | 100.00% |

In summary, the usage of polypropylene in the lubricant compositions as described herein for pressure diecasting and/or squeeze casting applications, with the polypropylene being either in the form of an aqueous emulsion or as a finely divided powder, will provide the following unique technical advantages and benefits: (1) cleaner, brighter castings with reduced staining, (2) reduced tendency for buildup of hard deposits on the dies, (3) markedly improved die lubrication and release properties, (4) improved economy in use of release agent products, (5) a reduced tendency for soldering to occur; and (6) applicant has also found that the lubricant compositions of the invention when applied (e.g., by spray treatment or other application to the die surface) provide excellent technical results in pressure diecasting due to: increased wetting temperatures which are possible relative to prior compositions (this improves cycle time and permits many more parts/hour to be produced), and a temperature plateau range also occurs which is very important (i.e., prior lubricants have a peak rather than a plateau) because the cooking of applicant's composition on the heat block or die surface permits heat to be taken out of the die in a very uniform manner, while leaving a continuous film of the lubricant intact.

While it will be apparent that the preferred embodiments of the invention disclosed are well calculated to fulfill the objects, benefits, and/or advantages of the invention, it will be appreciated that the invention is susceptible to modification, variation and change without departing from the proper scope or fair meaning of the subjoined claims.

What is claimed is:

1. A liquid carrier based diecasting lubricant and release agent composition, comprising in percent by weight:

(a) about 0.01% to about 40% polypropylene in solids form having an average molecular weight between about 500 and about 300,000, said polypropylene being substantially pure and being in the form of propylene polymers or propylene co-polymers, (b) about 0.1% to about 50% silicone oil, (c) about 0.01% to about 8% of emulsifying agent to assist in maintaining materials of the composition in an emulsified form, (d) about 0.01% to about 5% of an anti-corrosion agent, and the balance of a liquid carrier.

2. The composition of claim 1 wherein, said polypropylene has an average molecular weight between about 2500 and about 10,000.

3. A liquid carrier based diecasting lubricant and release agent composition, comprising in percent by weight:

(a) about 0.01% to about 40% polypropylene having an average molecular weight between about 500 and about 300,000, said polypropylene being in the form of substantially pure polypropylene solids, (b) about 0.1% to about 50% silicone oil, (c) about 0.01% to about 8% of emulsifying agent to assist in maintaining materials of the composition in an emulsified form, (d) zero to about 5% of an anti-corrosion agent, and the balance of a liquid carrier.

4. The composition of claim 3 wherein, component (a) is present from about 0.02% to about 20%, component (b) is present from about 0.1% to about 23%, component (c) is present from about 0.02% to about 6%, component (d) is present from about 0.01% to about 4%, and said polypropylene has an average molecular weight between about 2500 and about 10,000.

5. The composition of claim 4 wherein, component (a) is present from about 0.1% to about 15%, component (b) is present from about 0.5% to about 13%, component (c) is present from about 0.1% to about 5%, component (d) is present from about 0.1% to about 3%, and said polypropylene has an average molecular weight between about 4000 and about 5,000.

6. The composition of claim 5 wherein, said polypropylene is in finely divided dispersed form, and the liquid carrier is water.

7. The composition of claim 6 wherein, there is also included about 0.02% to about 35% of an additive selected from at least one material of the group consisting of synthetic or natural oil, a preservative agent, or a bactericide agent.

8. The composition of claim 3 wherein, component (a) is present from about 0.1% to about 15%, component (b) is present from about 0.5% to about 13%, component (c) is present from about 0.1% to about 5%, and component (d) is present from about 0.1% to about 3%.

9. The composition of claim 8 wherein, there is also included, about 0.02% to about 35% of an additive selected from at least one material of the group consisting of synthetic or natural oil, a preservative agent, or a bactericide agent.

10. The composition of claim 3 wherein, the liquid carrier is water.

11. The composition of claim 3 wherein, component (a) is present from about 0.02% to about 20%, component (b) is present from about 0.1% to about 23%, component (c) is present from about 0.02% to about 6%, component (d) is present from about 0.01% to about 4%, and said polypropylene has an average molecular weight between about 2500 and about 10,000.

12. The composition of claim 11 wherein, the liquid carrier is water.

13. The composition of claim 12 wherein, there is also included, about 0.1% to about 35% of an additive selected from at least one material of the group consisting of synthetic or natural oil, a preservative agent, or a bactericide agent.

14. A process of diecasting metal products including the steps of: treating the die with a die lubricant and release agent composition containing polypropylene dispersed in a liquid carrier, diecasting the metal product, and removing the product from the die, and wherein, said die lubricant and release agent composition is comprised of, in weight percent:

(a) about 0.01% to about 40% polypropylene in solids form having an average molecular weight between about 500 and about 300,000, said polypropylene being substantially pure and consisting essentially of propylene polymers or propylene co-polymers,
(b) about 0.1% to about 50% silicone oil,
(c) about 0.01% to about 8% of emulsifying agent to assist in maintaining materials of the composition in an emulsified form,
(d) about 0.01% to about 5% of an anti-corrosion agent, and the balance of a liquid carrier.

15. The process of claim 14 wherein,
component (a) is present from about 0.02% to about 20%,
component (b) is present from about 0.1% to about 23%,
component (c) is present from about 0.02% to about 6%,
component (d) is present from about 0.01% to about 4%, and
said polypropylene has an average molecular weight between about 2500 and about 10,000.

16. The process of claim 15 wherein, said polypropylene is in finely divided dispersed form, and the liquid carrier is water.

17. The process of claim 16 wherein,
there is also included about 0.1% to about 35% of an additive selected from at least one material of the group consisting of synthetic or natural oil, a preservative agent, or a bactericide agent.

18. A process of diecasting metal products including the steps of: treating the die with a die lubricant and release agent composition containing polypropylene dispersed in a liquid carder, diecasting the metal product, and removing the product from the die, and wherein,
said die lubricant and release agent composition is comprised of, in weight percent:
(a) about 0.01% to about 40% substantially pure polypropylene solids having an average molecular weight between about 500 and about 300,000,
(b) about 0.1% to about 50% silicone oil,
(c) about 0.01% to about 8% of emulsifying agent to assist in maintaining materials of the composition in an emulsified form,
(d) zero to about 5% of an anti-corrosion agent, and the balance of a liquid carrier.

19. The process of claim 18 wherein,
component (a) is present from about 0.1% to about 15%,
component (b) is present from about 0.5% to about 13%,
component (c) is present from about 0.1% to about 5%, and
component (d) is present from about 0.1% to about 3 %.

20. The process of claim 19 wherein,
there is also included in said composition, about 0.02% to about 35% of an additive selected from at least one material of the group consisting of synthetic or natural oil, a preservative agent, or a bactericide agent.

21. The process of claim 20 wherein,
the liquid carrier is water.

22. The process of claim 19 wherein,
there is also included in the composition, about 0.1% to about 35% of an additive selected from at least one material of the group consisting of synthetic or natural oil, a preservative agent, or a bactedcide agent, and
said polypropylene is in homopolymer form.

23. The process of claim 18 wherein,
the liquid carrier is water, and said polypropylene is in homopolymer form.

24. A process of diecasting metal products including the steps of: treating the die with a die lubricant and release agent composition containing polypropylene dispersed in a liquid carrier, diecasting the metal product, and removing the product from the die, and wherein,
said die lubricant and release agent composition is comprised of, in weight percent:
(a) about 0.01% to about 40% polypropylene homopolymer in solids form having an average molecular weight between about 500 and about 300,000,
(b) about 0.1% to about 50% silicone oil,
(c) about 0.01% to about 8% of emulsifying agent to assist in maintaining materials of the composition in an emulsified form,
(d) about 0.01% to about 5% of an anti-corrosion agent, and the balance of a liquid carrier.

25. The process of claim 24 wherein,
component (a) is present from about 0.02% to about 20%,
component (b) is present from about 0.1% to about 23%,
component (c) is present from about 0.02% to about 6%,
component (d) is present from about 0.01% to about 4%, and
said polypropylene has an average molecular weight between about 2500 and about 10,000.

26. The process of claim 25 wherein, said polypropylene is in finely divided dispersed form, and the liquid carrier is water.

27. The process of claim 26 wherein,
there is also included about 0.1% to about 35% of an additive selected from at least one material of the group consisting of synthetic or natural oil, a preservative agent, or a bactericide agent.

28. A process of diecasting metal products including the steps of: treating the die with a die lubricant and release agent composition containing polypropylene dispersed in a liquid carrier, diecasting the metal product, and removing the product from the die, and wherein,
said die lubricant and release agent composition is comprised of, in weight percent:
(a) about 0.01% to about 40% polypropylene homopolymer solids having an average molecular weight between about 500 and about 300,000,
(b) about 0.1% to about 50% silicone oil,
(c) about 0.01% to about 8% of emulsifying agent to assist in maintaining materials of the composition in an emulsified form,
(d) zero to about 5% of an anti-corrosion agent, and the balance of a liquid carrier.

29. The process of claim 28 wherein,
the liquid carrier is water, and said molecular weight is between about 2500 and about 10,000.

30. The process of claim 28 wherein,
component (a) is present from about 0.02% to about 20%, component (b) is present from about 0.1% to about 23%, component (c) is present from about 0.02% to about 6%, component (d) is present from about 0.01% to about 4%, and said polypropylene has an average molecular weight between about 2500 and about 10,000.

31. The process of claim 28 wherein, component (a) is present from about 0.1% to about 15%.

component (b) is present from about 0.5% to about 13%, component (c) is present from about 0.1% to about 5%, and component (d) is present from about 0.1% to about 3%.

32. The process of claim 31 wherein, there is also included in said composition, about 0.02% to about 35% of an additive selected from at least one material of the group consisting of synthetic or natural oil, a preservative agent, or a bactericide agent.

33. The process of claim 32 wherein, the liquid carrier is water.

34. The process of claim 31 wherein, there is also included in the composition, about 0.1% to about 35% of an additive selected from at least one material of the group consisting of synthetic or natural oil, a preservative agent, or a bactericide agent.

* * * * *

UNITED STATES PATENT AND TRADEMARK OFFICE

CERTIFICATE OF CORRECTION

PATENT NO. : 5,340,486

DATED : August 23, 1994

INVENTOR(S) : Anthony P. Willoughby

It is certified that error appears in the above-indentified patent and that said Letters Patent is hereby corrected as shown below:

Column 1, line 48, "pans" should be -- parts --.

Column 9, line 35, "carder" should be -- carrier --.

Signed and Sealed this

Thirtieth Day of May, 1995

*Attest:*

*Attesting Officer*

BRUCE LEHMAN

*Commissioner of Patents and Trademarks*